US009269310B1

(12) United States Patent
Froment et al.

(10) Patent No.: US 9,269,310 B1
(45) Date of Patent: Feb. 23, 2016

(54) PROGRESSIVE DISPLAY UPDATES

(75) Inventors: Arnaud M. Froment, San Jose, CA (US); Mark S. Tamura, Sunnyvale, CA (US)

(73) Assignee: AMAZON TECHNOLOGIES, INC., Reno, NV (US)

( * ) Notice: Subject to any disclaimer, the term of this patent is extended or adjusted under 35 U.S.C. 154(b) by 1044 days.

(21) Appl. No.: 13/398,749

(22) Filed: Feb. 16, 2012

(51) Int. Cl.
*G09G 3/34* (2006.01)
*G09G 3/20* (2006.01)

(52) U.S. Cl.
CPC ..... *G09G 3/344* (2013.01); *G09G 3/2014* (2013.01); *G09G 3/2092* (2013.01)

(58) Field of Classification Search
CPC ..... G09G 3/34; G09G 3/26; G09G 5/36
USPC ..... 345/107, 467, 36, 442, 589, 619, 698, 345/629; 715/764
See application file for complete search history.

(56) References Cited

U.S. PATENT DOCUMENTS 7,158,127 B1 * 1/2007 Dotson ..... G09G 5/006 345/1.1
8,564,530 B2 * 10/2013 Low et al. ..... 345/107
8,819,568 B1 * 8/2014 Hull ..... G06F 15/0291 345/107
8,890,873 B2 * 11/2014 Shustorovich ..... G06T 11/00 345/467
2007/0052667 A1 * 3/2007 Zhou ..... G09G 3/344 345/107
2008/0214239 A1 * 9/2008 Hashimoto et al. ..... 455/557
2008/0278436 A1 * 11/2008 Sato ..... 345/107
2009/0009526 A1 * 1/2009 Rice ..... G06T 11/40 345/589
2009/0256798 A1 * 10/2009 Low et al. ..... 345/107
2009/0284532 A1 * 11/2009 Kerr ..... G06F 3/0481 345/442
2009/0295753 A1 12/2009 King et al.
2010/0194692 A1 * 8/2010 Orr et al. ..... 345/173
2011/0187766 A1 * 8/2011 Yamada ..... G09G 3/344 345/698
2012/0154294 A1 6/2012 Hinckley et al.
2012/0162238 A1 * 6/2012 Fleck et al. ..... 345/545
2012/0194542 A1 * 8/2012 Matsui et al. ..... 345/619
2012/0212510 A1 * 8/2012 Hewitt et al. ..... 345/650
2012/0223884 A1 * 9/2012 Bi ..... G06F 1/1694 345/158
2012/0287175 A1 * 11/2012 Yamada ..... 345/690
2013/0083033 A1 * 4/2013 Shustorovich ..... G06F 15/0291 345/467
2013/0088511 A1 * 4/2013 Mitra ..... G06F 3/0483 345/629
2013/0162667 A1 * 6/2013 Eskolin ..... G06F 3/0488 345/619

OTHER PUBLICATIONS

Final Office Action for U.S. Appl. No. 13/247,670, mailed on Apr. 10, 2014, Tiffany Yun, "Electronic Devices with Pressure-Sensitive Bezels", 34 pages.
Office Action for U.S. Appl. No. 13/247,670, mailed on Nov. 20, 2013, Tiffany Yun, "Electronic Devices with Pressure-Sensitive Bezels", 23 pages.

* cited by examiner

*Primary Examiner* — Thuy Pardo
(74) *Attorney, Agent, or Firm* — Seyfarth Shaw LLP; Ilan N. Barzilay; Joseph M. Walker

(57) ABSTRACT

Techniques for performing progressive updates on displays of respective electronic devices. The techniques may update a display in two or more steps for the purpose of first providing a quick response and thereafter providing a higher quality rendering of the update. For instance, when the techniques receive an indication that the device has received an instruction to perform an update on a particular portion of the display, the techniques may compare one or more aspects of the update to one or more predefined criteria. If the update satisfies the criteria, then the techniques may instruct a display controller to first perform the update in black and white and may set a timer for later instructing the display controller to perform the update in grayscale.

21 Claims, 5 Drawing Sheets

PROGRESSIVE DISPLAY UPDATES

BACKGROUND

A large and growing population of users is enjoying entertainment through the consumption of digital content items (or simply "content items"), such as music, movies, images, electronic books, and so on. The users employ various electronic devices to consume such content items. Among these electronic devices are electronic book (eBook) reader devices, cellular telephones, personal digital assistants (PDAs), portable media players, tablet computers, netbooks, and the like. As the quantity of available electronic media content continues to grow, along with increasing proliferation of devices to consume that media content, finding ways to enhance user experience continues to be a priority.

BRIEF DESCRIPTION OF THE DRAWINGS

The detailed description is set forth with reference to the accompanying figures. In the figures, the left-most digit(s) of a reference number identifies the figure in which the reference number first appears. The use of the same reference numbers in different figures indicates similar or identical items or features.

DETAILED DESCRIPTION

Overview

Figure 1:
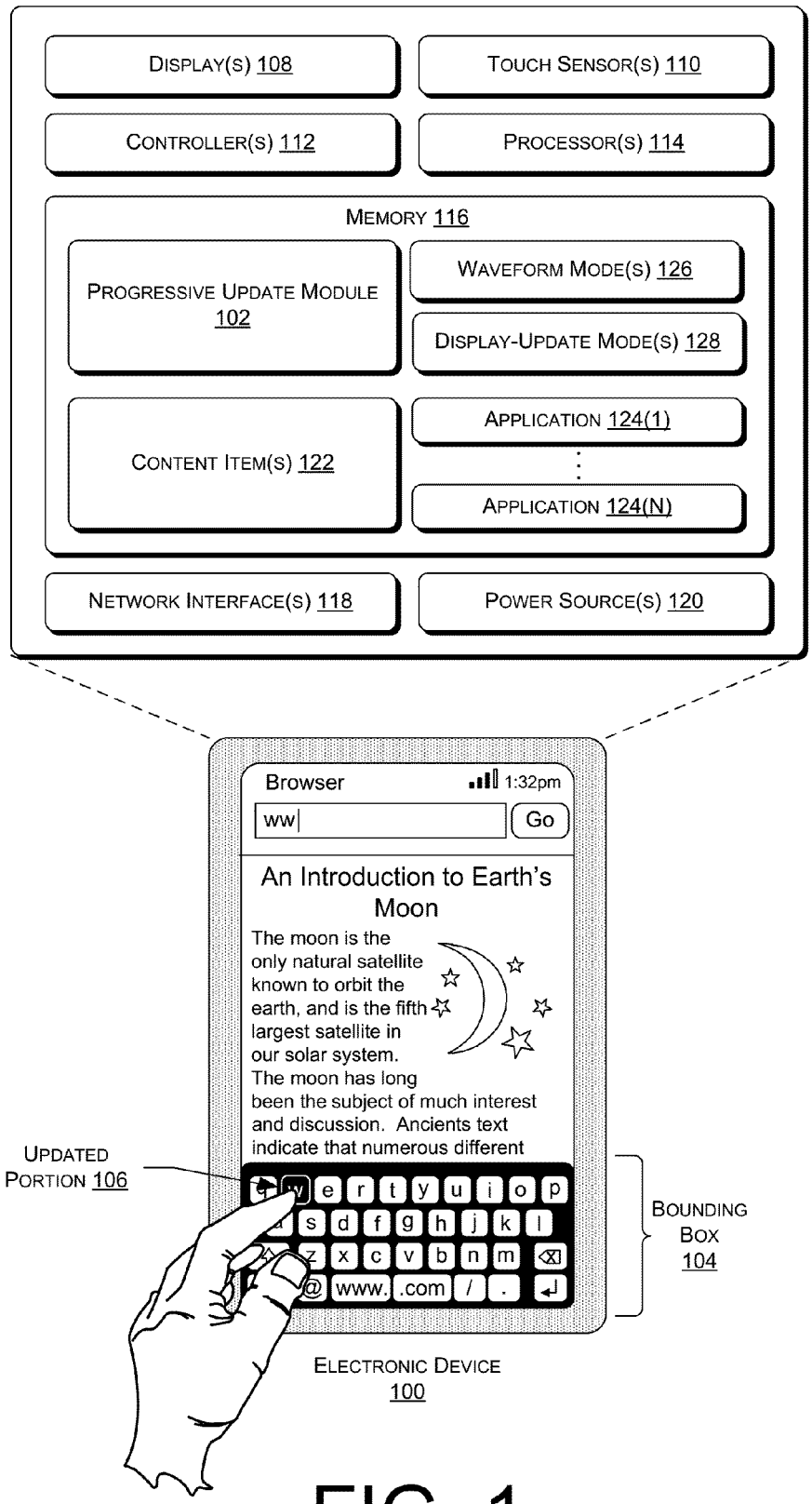
FIG. 1 illustrates an example electronic device configured with functionality for progressively updating a display of the electronic device to provide an initial prompt response and a subsequent higher quality rendering.

This disclosure describes, in part, techniques for performing progressive updates on displays of respective electronic devices. In some instances, the electronic devices utilize electronic paper displays that mimic the look and feel of ordinary paper, while in other instances the devices utilize other types of displays as discussed below.

In either instance, the techniques may update a display in two or more steps for the purpose of first providing a prompt response and thereafter providing a higher quality rendering of the update. For instance, when the techniques receive an indication that the device has received an instruction to perform an update on a particular portion of the display, the techniques may compare one or more aspects of the update to one or more predefined criteria.

If the aspect(s) satisfy the criteria, then the techniques may instruct a display controller of the device to perform the update using a first mode (e.g., a particular waveform mode, a particular display-update mode, etc.) that completes relatively quickly. For instance, the techniques may instruct the controller to perform the update using a mode that is effective to posterize pixel values associated with the update and render the update on the display in black and white. That is, the techniques may instruct the controller to perform the update using only black and white pixel values. As used herein, a "black" pixel value may denote a darkest pixel value that a display is able to render, while a "white" pixel value may denote a lightest pixel value that the display is able to render.

In addition, the techniques may then send an instruction to the controller to perform the update using a second mode, absent an indication that the portion is to be updated again within a set period of time (e.g., measured from the performing of the update in the first mode). However, if the techniques receive, prior to expiration of the set period of time, an indication that the portion is to be updated again, then the techniques may refrain from sending an instruction to the display controller to perform the update using the second mode.

For instance, the techniques may set a timer that, upon expiration, results in the techniques sending an instruction to the controller to perform the update using a second mode, which may take more time to complete but may result in an image of greater quality than the first mode. For instance, upon expiration of the timer, the techniques may instruct the controller to render a grayscale version of the image by, for example, rendering each initial pixel value associated with the update (rather than posterized values). By first rendering an update in a relatively fast mode and then following up by rendering the update in a higher quality mode, the techniques provide a prompt response on the display while still ultimately providing a high quality image. As used herein, rendering an image in grayscale may include rendering an image using black pixel values, white pixel values, and one or more pixel values there between (i.e., "gray" pixel values).

In one of many different examples, the techniques function to perform progressive updates on virtual keyboards rendered on electronic paper displays. As is known, electronic paper displays support the rendering of black, white, and gray pixels, although the rendering of an update with multiple shades of gray typically takes longer than the rendering of an update with fewer shades of gray or updates in black in white. For example, a purely black and white update on an electronic paper display may render about three times faster than a 16-color grayscale update. However, a purely black and white update may look less appealing to the human eye as compared to a grayscale update. This may be especially true in the case of rendered text, as edges of the letters of the text may appear jagged when rendered purely in black and white.

In order to balance the speed and quality of updates on a virtual keyboard rendered on an electronic paper display, the techniques described herein may first render updates in black and white to provide a fast visual feedback and then "repair" the black and white rendered pixels in grayscale, changing some white pixels to light gray and some black pixels to dark gray for instance.

To do so, when a virtual keyboard application of an electronic device is invoked, coordinates of a bounding box that surrounds the virtual keyboard on the display may be passed to a component that abstracts the display controller and is in charge of instructing the display controller to update pixels within the bounding box on the display. In response to receiving the coordinates of this bounding box, the component may enable a "fast keyboard mode" (FKM) for any pixel updates that occur within the bounding box.

After the component has invoked FKM, when an application on the device updates one or more pixels, the techniques may generate a damage rectangle. The damage rectangle may comprise a rectangle fully surrounding each pixel that is being changed via the update. After generating the damage rectangle, the techniques pass the damage rectangle down to the component that instructs the controller to update the display.

After receiving the damage rectangle, the component first determines whether the damage rectangle resides (e.g., partially or entirely) within the bounding box associated with the virtual keyboard. If not, then the component may instruct the controller to perform the update in a normal fashion by, for instance, updating each value associated with the update. If, however, the damage rectangle is within the bounding box, then the component may compare one or more aspects of the damage rectangle to one or more predefined criteria. For instance, the component may compare a height, a width, and/or an area of the damage rectangle to respective predefined ranges to determine whether or not these values fall within the corresponding ranges. If not, then the component may again instruct the controller to perform the update in a normal manner.

If, however, these values fall within the corresponding ranges, then the component may instruct the controller to update the pixels within the damage rectangle contained in the bounding box in black and white. In addition, the component may set a timer that, upon expiration, reminds the component to subsequently instruct the display controller to update the pixels within the damage rectangle contained in the bounding box in grayscale. If, however, the component receives an indication that pixels of the damage rectangle are being updated prior to expiration of the timer, then the component may cease execution of the timer and perform the new update in lieu of the previously scheduled grayscale update.

In one virtual keyboard example, a device is configured to invert the color of a key in response to a user pressing the key on a touchscreen of the device. In addition, the device may be configured to re-invert these colors upon the user releasing the key. For example, the black text of a key over a white background may become white text over a black background in response to a user selecting the key, and may re-invert to black text over a white background in response to the user releasing the key. In each instance, the update may specify different values of black, white, and gray pixels.

In response to a user selecting a key in this manner, the keyboard application may identify the selection, may identify pixel values of an update associated with the selection, and may fill a framebuffer of the device with the identified pixel values. In addition, the application may push the corresponding damage rectangle to the component described above.

In response to the receiving this damage rectangle, the component may compare the location of the damage rectangle to the initially received bounding box of the virtual keyboard. Because the update is within the bounding box, the component may instruct the display controller to render a posterized version of the update (i.e., black and white versions of the pixel values of the update). In some instances, the posterizing of a pixel comprises changing a pixel value to either black or white based on whether the initial pixel value is closer to black or white. In other instances, the techniques may set a threshold pixel value and posterize values that are greater than the threshold value to black and those values that are less than the threshold value to white.

After or prior to instructing the controller to render the black and white version of the update, the component may set a timer for instructing the controller to perform the grayscale update. In this example, if the user keeps his finger on the key for longer than the time period associated with the timer, then the white-on-black to black-on-white transition is deferred and the component auto-repairs the update by instructing the display controller to render the pixels within the damage rectangle in grayscale.

If, however, the user lifts his finger (in the case of a simple tap of the key, without a purposeful hold on the key), then the keyboard application may issue a new update to the pixels within the damage box and may provide the same damage rectangle to the component. In response, the component may cease execution of the timer (and, hence, the timer-driven grey scale auto-repair of the previous transition), may instruct the display controller to render a posterized black and white version of the pixels within the damage rectangle, and may again start the timer for performing the grayscale update. If no updates occur to these pixels prior to expiration of the timer, then the component may instruct the controller to perform a grayscale update of the pixels in the damage rectangle upon expiration of the timer. Finally, when the virtual keyboard application is dismissed, the component may disable FKM against the bounding box that previously surrounded the now dismissed keyboard.

While some of the examples described herein are discussed in terms of virtual keyboards, it is to be appreciated that the described techniques apply equally to other usage scenarios. For instance, these techniques may apply when rendering any type of visual content on a display, such as text in a text box, images, progress bars, and the like. For instance, as a user types text into a text box, this text may be rendered using a first mode and, thereafter, rendered using a second, different mode if no update to that portion is received within a set period of time after the rendering in the first mode. In another example, a device may render an image (e.g., a progress bar) in a first mode and, thereafter, may render the image in the second mode if no update to that portion is received within a set period of time after the rendering in the first mode. Of course, while a few additional examples have been given, these represent but a few of many.

Example Electronic Device

FIG. 1 illustrates an example electronic device 100 that includes a progressive update module 102 configured to progressively update a display of the device, as described above. For instance, the progressive update module 102 may receive an indication of a bounding box 104 defining an area of the display of the device for which to implement the progressive update techniques. Thereafter, in response to receiving an indication that a portion 106 of the display is to be updated, the module 102 may determine whether the portion 106 is within the bounding box. If so, then module 102 may determine whether one or more aspects of the update satisfy one or more criteria and, if so, may progressively update the portion 106.

For instance, the module 102 may initially instruct the device 100 to perform the update in black and white and may set a timer that, upon expiration, reminds the module 102 to instruct the device 100 to subsequently perform one or more grayscale updates of the portion 106. If no updates occur to the portion 106 prior to expiration of the timer, the module 102 may proceed to instruct the device 100 to update the portion 106 in grayscale.

The device 100 may comprise any type of mobile electronic device (e.g., a dedicated electronic book reader device, a tablet computing device, a laptop computer, a multifunction communication device, a portable digital assistant (PDA), etc.) or non-mobile electronic device (e.g., a desktop computer, a television, etc.). Regardless of the specific implementation of the electronic device 100, the device 100 may include one or more displays 108, one or more touch sensors 110, and corresponding controllers 112 (e.g., a display controller, a touch sensor controller, etc.). The one or more displays 108 may represent liquid crystal displays (LCDs), plasma displays, Light Emitting Diode (LED) displays, electronic paper displays, and/or the like.

In some instances, the electronic device 100 utilizes at least one electronic paper display for rendering content on the device 100. The touch sensor(s) 110, meanwhile, may comprise a capacitive touch sensor, an interpolating force sensitive resistance (IFSR) sensor, or any other type of touch sensor. In addition, in some instances the device 100 includes a touch sensor underneath, atop, or integral with the electronic paper display, thus defining a touch-sensitive electronic paper display.

Electronic paper displays represent an array of display technologies that largely mimic the look of ordinary ink on paper. In contrast to conventional backlit displays, electronic paper displays typically reflect light, much as ordinary paper does. In addition, electronic paper displays are often bi-stable, meaning that these displays are capable of holding text or other rendered images even when very little or no power is supplied to the display.

In one implementation, the electronic paper display 108 comprises an electrophoretic display that moves particles between different positions to achieve different color shades. For instance, in a pixel that is free from a color filter, the pixel may be configured to produce white when the particles within this pixel are located at the front (i.e., viewing) side of the display. When situated in this manner, the particles reflect incident light, thus giving the appearance of a white pixel. Conversely, when the particles are pushed near the rear of the display, the particles absorb the incident light and, hence, cause the pixel to appear black to a viewing user. In addition, the particle may situate at varying locations between the front and rear sides of the display to produce varying shades of gray. Furthermore, as used herein, a "white" pixel may comprise any shade of white or off white, while a "black" pixel may similarly comprise any shade of black.

In another implementation, the electronic paper display 108 comprises an electrophoretic display that includes oppositely charged light and dark particles. In order to create white, the display controller moves the light particles to the front side of the display by creating a corresponding charge at an electrode near the front and moves the dark particles to the back of the display by creating a corresponding charge at an electrode near the back. In order to create black, meanwhile, the controller changes the polarities and moves the dark particles to the front and the light particles to the back. Furthermore, to create varying shades of gray, the controller may utilize different arrays of both light and dark particles.

Of course, while two different examples have been given, it is to be appreciated that the electronic paper displays described herein may comprise any other type of electronic paper technology, such as gyricon displays, electrowetting displays, electrofluidic displays, interferometric modulator displays, cholestric liquid crystal displays, and the like. In addition, while some of the displays described below are discussed as rendering black, white, and varying shades of gray, it is to be appreciated that the described techniques apply equally to electronic paper displays capable of rendering color pixels. As such, the terms "white", "gray", and "black" may refer to varying degrees of color in implementations utilizing color displays. For instance, where a pixel includes a red color filter, a "gray" value of the pixel may correspond to a shade of pink while a "black" value of the pixel may correspond to a darkest red of the color filter.

FIG. 1 further illustrates that the electronic device 100 includes one or more processors 114 and memory 116, as well as one or more network interfaces 118 and one or more power sources 120. The network interfaces 118 may support both wired and wireless connection to various networks, such as cellular networks, radio, WiFi networks, short range networks (e.g., Bluetooth), IR, and so forth.

Depending on the configuration of the electronic device 100, the memory 116 (and other memories described throughout) is an example of computer storage media and may include volatile and nonvolatile memory. Thus, the memory 116 may include, but is not limited to, RAM, ROM, EEPROM, flash memory, or other memory technology, or any other medium which can be used to store media items or applications and data which can be accessed by the electronic device 100.

The memory 116 may be used to store any number of functional components that are executable on the processors 114, as well as data and content items that are rendered by the electronic device 100. Thus, the memory 116 may store an operating system and one or more content items 122, such as eBooks, audio books, songs, videos, still images, and the like. The memory 116 of the electronic device 100 may also store one or more applications 124(1), . . . , 124(N), such as a virtual keyboard application to render a virtual keyboard on the display 108, a content presentation applications to render content items on the device 100, and the like. The content presentation applications may be implemented as various applications depending upon the content items. For instance, the application may be an electronic book reader application for rending electronic books, an audio player for playing audio books or songs, a video player for playing video, and so forth.

As illustrated, in this example the memory 116 also stores indications of multiple different waveform modes 126 and display-update modes 128 for rendering content on the display 108. In response to receiving a request to render an image or otherwise perform an update on the display 108, the device 100 may use one or more waveform modes 126 for altering positions of particles of the electronic paper display 108 and/or one or more display-update modes for updating the display 108.

As described above, one of the applications 124(1)-(N) may comprise a virtual keyboard application that is invoked, in one example, when a cursor is moved to a text box rendered on the display 108. When the virtual keyboard application is invoked, this application may identify the bounding box 104 surrounding the virtual keyboard and may send coordinates of the bounding box to the progressive update module 102. Thereafter, when a user selects keys on the virtual keyboard, such as the example selection by the user of the "w" key, the virtual keyboard application may map this selection to a particular key, may identify the coordinates of this key, and may fill a framebuffer with pixel values corresponding to the update. The virtual keyboard application may also send an indication of this update to the progressive update module 102.

In response to receiving this indication of the impending update, the module 102 may first determine whether the portion 106 is within the bounding box 104. If so, then the module 102 may then determine whether the update satisfies one or more criteria, such as whether the height, width, and area of the update are within corresponding predefined ranges. If the update satisfies these criteria, then the module 102 may instruct the display controller 112 to first render the update in black and white using a particular waveform mode 126 or a particular display-update mode 128.

In addition, the module 102 may set a timer for instructing the controller 112 to perform the update in grayscale, again using a particular waveform mode 126 or a particular display-update mode 128. If the timer expires prior to receiving an indication of another update for this portion 106, then the module 102 may instruct the controller 112 to render the update in grayscale. For instance, the module 102 may instruct the controller 112 to render the update without flashing the screen, such that any previously rendered pixels remain on the display and are not removed. Therefore, the second update may effectively sharpen or clarify the already rendered black and white image.

If, however, the module 102 receives an indication of another update to be performed to the portion 106 prior to expiration of the timer, then the module 102 may cease execution of the timer, instruct the controller 112 to perform the new update in black and white, and again set a timer for instructing the controller 112 to perform the update in grayscale if the new update satisfies the criteria. This update may occur, for instance, in response to the user removing his finger from the "w" key, resulting in the virtual keyboard application issuing an update to re-invert the colors of the key.

In some instances, the electronic device 100 may have features or functionality in addition to those that FIG. 1 illustrates. For example, the device 100 may also include additional data storage devices (removable and/or non-removable) such as, for example, magnetic disks, optical disks, or tape. The additional data storage media may include volatile and nonvolatile, removable and non-removable media implemented in any method or technology for storage of information, such as computer readable instructions, data structures, program modules, or other data. In addition, some or all of the functionality described as residing within the device 100 may reside remotely from the device 100 in some implementations. In these implementations, the device 100 may utilize the network interfaces 118 to communicate with and utilize this functionality.

Various instructions, methods and techniques described herein may be considered in the general context of computer-executable instructions, such as program modules, executed by one or more computers or other devices. Generally, program modules include routines, programs, objects, components, data structures, and the like for performing particular tasks or implement particular abstract data types. These program modules and the like may be executed as native code or may be downloaded and executed, such as in a virtual machine or other just-in-time compilation execution environment. Typically, the functionality of the program modules may be combined or distributed as desired in various embodiments. An implementation of these modules and techniques may be stored on or transmitted across some form of computer readable media.

Example Processes

Figure 2:
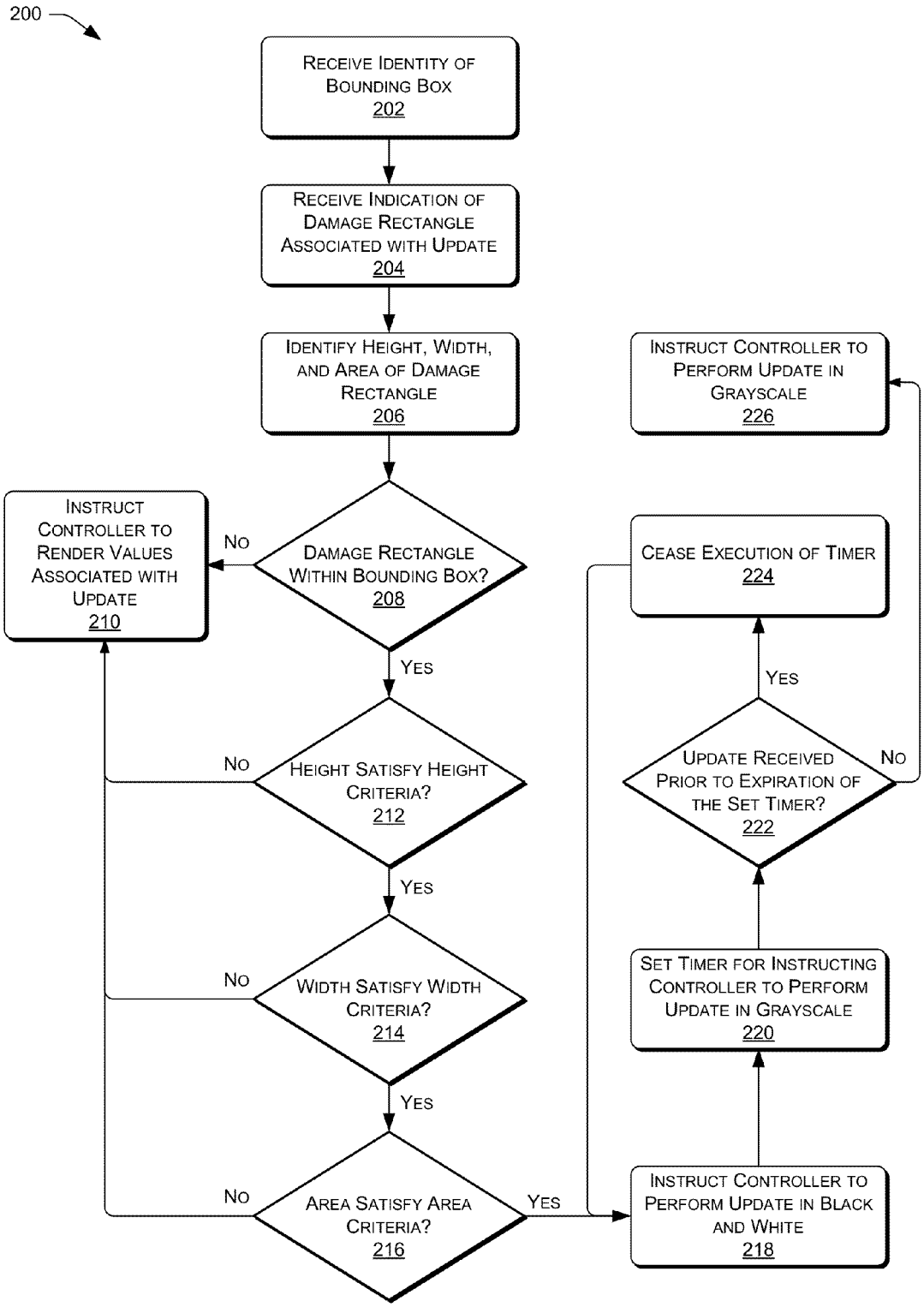
FIG. 2 illustrates an example process for first performing an update in black and white and then performing the update in grayscale, in the event that the update satisfies one or more predefined criteria.

FIG. 2 illustrates an example process 200 for first performing an update in black and white and then performing the update in grayscale if the update satisfies one or more predefined criteria. This process (as well as each process described herein) is illustrated as a logical flow graph, each operation of which represents a sequence of operations that can be implemented in hardware, software, or a combination thereof. In the context of software, the operations represent computer-executable instructions stored on one or more computer-readable storage media that, when executed by one or more processors, perform the recited operations. Generally, computer-executable instructions include routines, programs, objects, components, data structures, and the like that perform particular functions or implement particular abstract data types. The order in which the operations are described is not intended to be construed as a limitation, and any number of the described operations can be combined in any order and/or in parallel to implement the process. Furthermore, while portions of the process are described as being implemented by the progressive update module 102, in other instances the process may be performed in whole or in part by other entities residing at other locations (e.g., on a server, etc.).

The process 200 includes, at 202, the progressive update module 102 receiving an identity of a bounding box. For instance, upon invocation of a virtual keyboard on a display of a device, the corresponding virtual keyboard application may provide coordinates of the rectangle bounding the virtual keyboard to the module 102. In this and other examples, the bounding box may comprise a portion of or the entire display.

Sometime after receiving the identity of the bounding box, the module 102 may receive an indication of a damage rectangle associated with an update at 204. The damage rectangle may comprise a rectangle (or other shape) that fully encompasses each pixel being changed in an updated. In some instance, the damage rectangle comprises a smallest rectangle that can encompass each pixel that is to be updated.

At 206, and in response, the module 102 may identify a height, a width, and an area of the damage rectangle and, at 208, may determine whether the damage rectangle is within (entirely or partially) the bounding box identified at 202. If the damage rectangle is not within the bounding box, then the module 102 may instruct the display controller to render pixel values associated with the update at 210. That is, the module 102 may simply instruct the controller to update the damage rectangle in accordance with the instructions and pixel values provided by the application requesting the update. In some instances, the module 102 may simply refrain from contacting the controller in this scenario, thus allowing the controller to perform the update in a routine manner.

If, however, the module 102 determines that the damage rectangle is within the bounding box, then at 212 the module 102 may determine whether the height of the update satisfies predefined height criteria. This may include determining whether a height (measured in pixels) of the damage rectangle is greater than a threshold value, less than a threshold value, or within a threshold range. In some instances, the threshold value(s) or the threshold range may be based on one or more factors, such as an orientation of the device, a type of keyboard that the device currently renders (e.g., English, Spanish, numeric, etc.), a current font size used by the device, or the like.

If the height of the update does not satisfy the height criteria, then the module 102 may instruct the controller to render the values associated with the update. If, however, the height does satisfy the height criteria, then at 214 the module 102 may determine whether the width of the update satisfies the width criteria. This may include determining whether a width (measured in pixels) of the damage rectangle is greater than a threshold value, less than a threshold value, or within a threshold range. In some instances, the threshold value(s) or the threshold range may again be based on one or more factors, such as an orientation of the device, a type of keyboard that the device currently renders (e.g., English, Spanish, numeric, etc.), a current font size used by the device, or the like.

If the width of the update does not satisfy the width criteria, then the module 102 may instruct the controller to render the values associated with the update. If, however, the width does satisfy the width criteria, then at 216 the module 102 may determine whether the total area of the update satisfies the total area criteria. This may include determining whether a total area (measured in square pixels) of the damage rectangle is greater than a threshold value, less than a threshold value, or within a threshold range. In some instances, the threshold value(s) or the threshold range may again be based on one or more factors, such as an orientation of the device, a type of keyboard that the device currently renders (e.g., English, Spanish, numeric, etc.), a current font size used by the device, or the like.

If the area of the update does not satisfy the area criteria, then the module 102 may instruct the controller to render the values associated with the update. If, however, the area does satisfy the area criteria, then at 218 the module 102 may instruct the controller to render the update in black and white. For instance, the module 102 may instruct the display controller to posterize the pixel values within the framebuffer and then render the posterized values, or the module 102 may itself posterize pixel values, fill the framebuffer with the posterized values, and instruct the controller to render the posterized pixel values.

In either instance, at 220 the module 102 may then set a timer to remind the module 102 to instruct the controller to perform the update in grayscale upon expiration of the timer. At 222, the process 200 queries whether an update has been received for the damage rectangle prior to expiration of the timer. If the module 102 has received an indication of another update to the damage rectangle, then the module 102 may cease execution of the timer at 224 and may proceed to instruct the controller to perform the new update in black and white and then set a new timer for instructing the controller to subsequently perform the new update in grayscale.

If, however, the module 102 does not receive an indication of an update to the damage rectangle prior to expiration of the timer, then at 226 the module 102 instructs the controller to perform the update in grayscale. For instance, the module 102 may instruct the controller to render the pixel values initially filled in the framebuffer by the application requesting the update.

By implementing the process 200, the progressive update module 102 provides a fast response to a user (via a black and white update) along with a higher quality rendering (via a subsequent grayscale update). In addition, by the setting a timer for instructing the controller to perform the subsequent grayscale update and by allowing subsequent updates to cease execution of the timer, the module 102 ensures that outdated grayscale updates do not occur on the display.

Figure 3A:
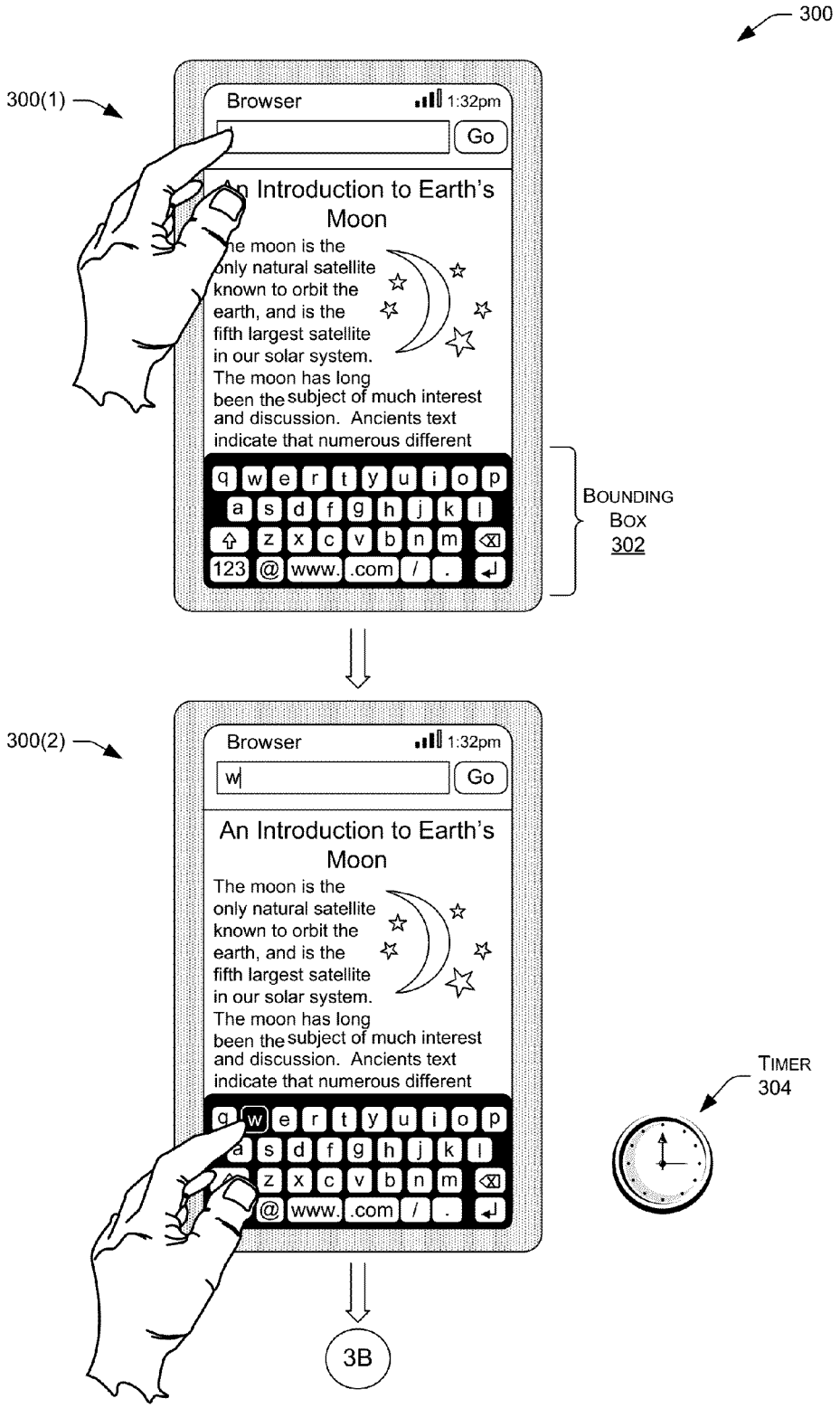
FIGS. 3A-3B illustrate an example process that includes initiating a keyboard application, receiving a selection of a key on the keyboard, performing an update associated with the selection in black and white, and setting a timer for subsequently performing the update in grayscale. In this example process, however, the user removes his finger from the key, triggering another update of the area of the display associated with the key. This additional update causes the device to render the new update in black and white, cease execution of the timer, and set another timer for subsequently performing the new update in grayscale. After expiration of this new timer, the device then performs the new update in grayscale, thus providing a fast response (in black and white) followed by a higher quality rendering (in grayscale).
Figure 3B:
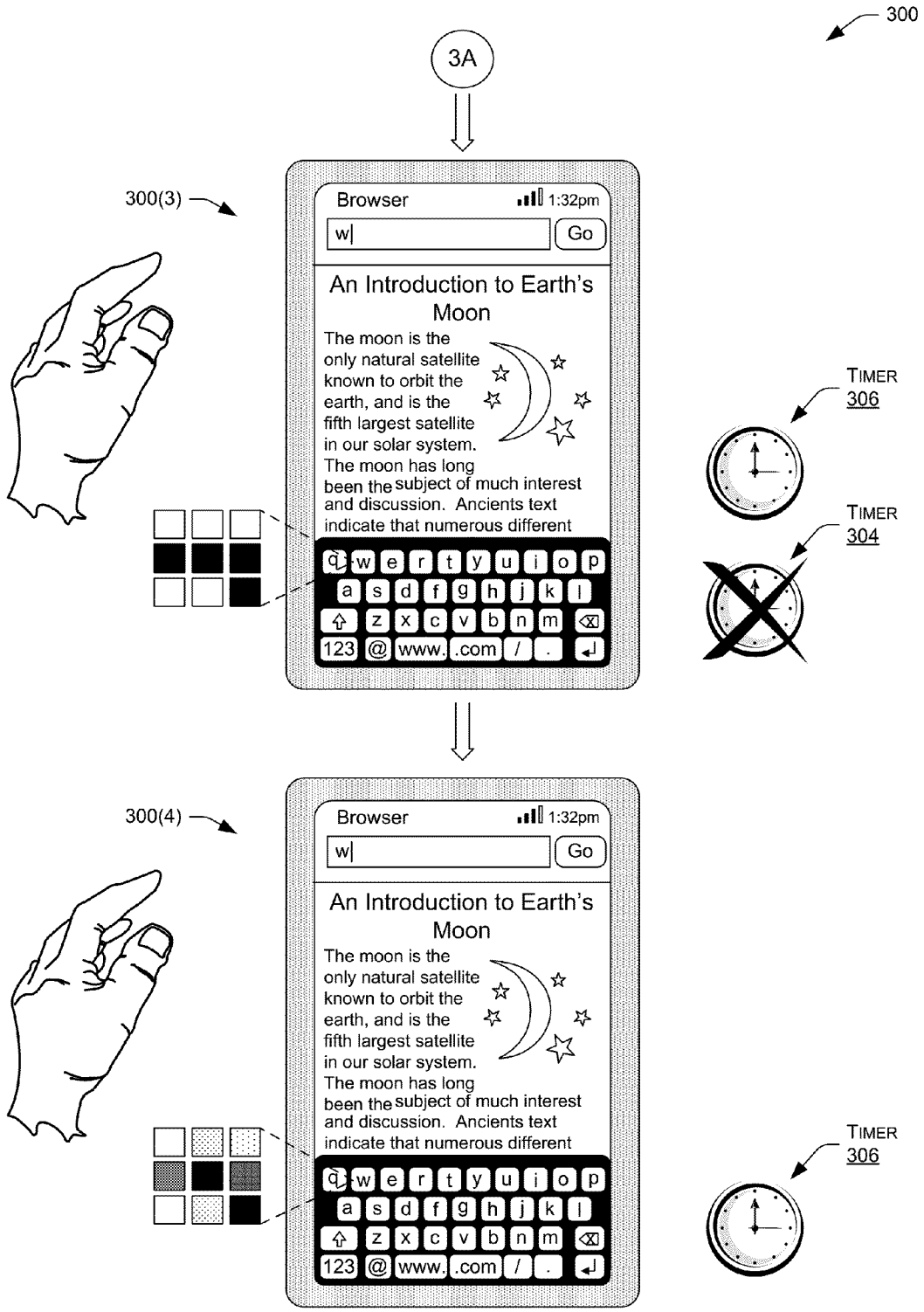

FIGS. 3A-3B illustrate an example process 300 that highlights one example usages scenario for the techniques described above. At 300(1), a user makes a selection in a text box rendered on a touch-sensitive electronic paper display of a device. This selection invokes the virtual keyboard application of the device, which in turn renders a virtual keyboard on the display. In addition, the application identifies a bounding box 302 that encompasses this virtual keyboard and provides an indication of this bounding box 302 to the progressive update module 102.

At 300(2), the virtual keyboard application receives a user's selection on the touchscreen of a "w" key. The application, which is configured to invert the text of a selected key, issues an update associated with this selection by filling a framebuffer of the device with pixel values corresponding to the update. In addition, the application provides an indication of the area that is to be updated to the progressive update module 102.

In response to receiving this area, the module 102 determines that the area to be updated is within the bounding box 302 and that the height, width, and area of the update satisfy the corresponding predefined criteria. As such, the module 102 instructs the display controller to render a black and white version of the update, as illustrated at 300(2). In addition, the module 102 sets a timer 304 to remind the module to instruct the display controller to render a grayscale version of the update upon expiration of the timer.

FIG. 3B continues the illustration of the process 300 and includes, at 300(3), the user removing his finger from the "w" key prior to expiration of the timer 304. As such, the virtual keyboard application issues an update to the controller to re-invert the text back to black-on-white and fills the framebuffer with pixel values corresponding to this update. The application also provides an indication of the update to the progressive update module 102.

In response to receiving the new update, the module 102 may determine that this update is to the same damage rectangle associated with the timer 304 and, because the timer 304 has yet to expire, may cease execution of the timer 304. The module 102 may also instruct the controller to render a black and white version of the new update and may set a new timer 306. At 300(4), the module 102 determines that no update to the same damage rectangle has been received prior to expiration of the timer 306 and, therefore, the module 102 instructs the controller to perform the update in grayscale, as illustrated. By providing a prompt black and white response followed up with a subsequent, higher quality grayscale update, the process 300 allows the user to quickly appreciate that his input has been accepted without unduly sacrificing the quality of the rendered keyboard.

Figure 4:
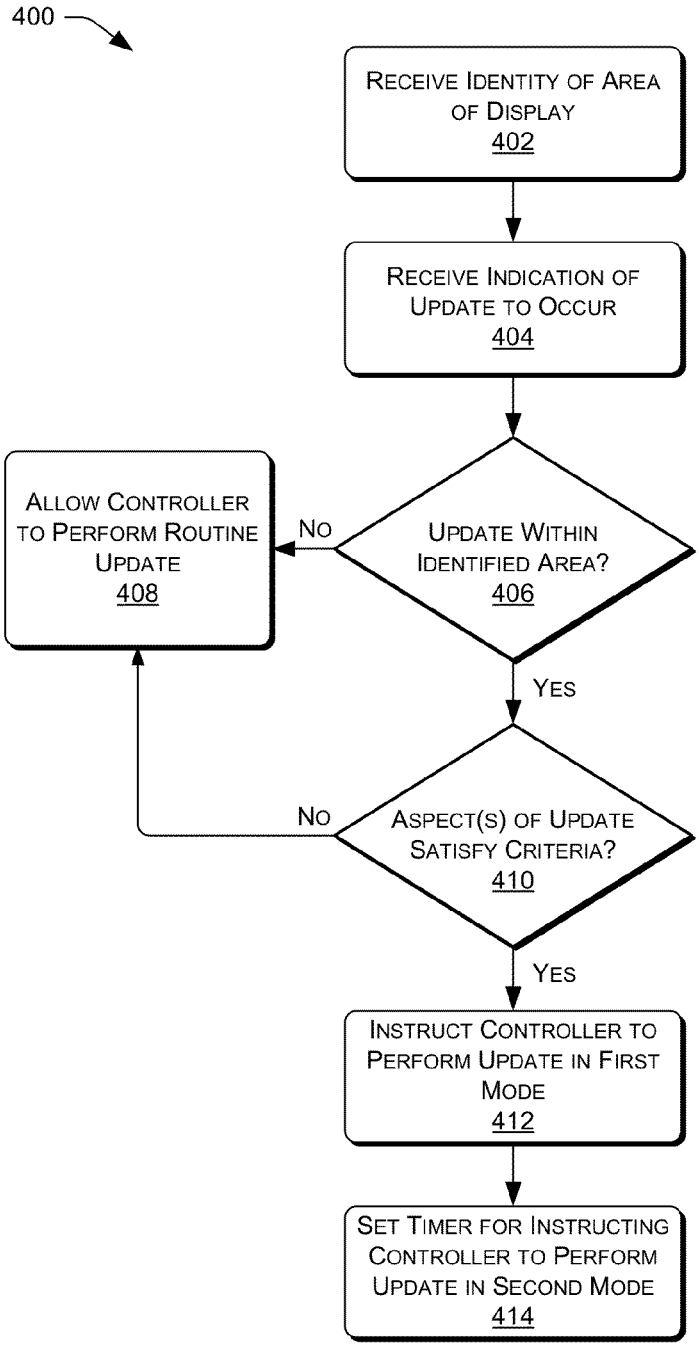
FIG. 4 illustrates an example process for performing progressive updates using the techniques described herein.

FIG. 4 illustrates an example process 400 for performing progressive updates using the techniques described herein. At 402, the process 400 receives an identity of an area of a display for which to implement the progressive update techniques. For instance, the process 400 may receive an indication of a bounding box that encompasses a virtual keyboard. At 404, the process 400 subsequently receives an indication of an update that is to occur on the display.

At 406, and in response, the process 400 determines whether the update is within the area identified at 402. If not, then at 408 the process 400 allows the controller to perform the update in a routine manner. That is, the process 400 refrains from implementing the progressive update techniques.

If, however, the process 400 determines that the update is within the identified area, then at 410 the process 400 determines whether one or more aspects of the update satisfy one or more predefined criteria. If not, then the process 400 refrains from implementing the progressive update techniques. If the aspects do comply with the criteria, then at 412 the process 400 instructs the controller to perform the update in a first mode. The first mode may comprise a particular waveform mode or a particular display-update mode. In addition, at 414 the process 400 sets a timer for instructing the controller to perform the update in a second, different mode. Again, the second mode may comprise a particular waveform mode or a particular display-update mode. In some instances, the first mode is configured to render an image more quickly than the second mode, while the second mode is configured to render an image of higher quality than the first mode.

CONCLUSION

Although the subject matter has been described in language specific to structural features and/or methodological acts, it is to be understood that the subject matter defined in the appended claims is not necessarily limited to the specific features or acts described. Rather, the specific features and acts are disclosed as exemplary forms of implementing the claims.

What is claimed is:

1. One or more non-transitory computer-readable media storing computer-executable instructions that, when executed on one or more processors of an electronic device that includes an electronic paper display and a display controller to update the electronic paper display, cause the one or more processors to perform acts comprising:

receiving a first indication corresponding to a first update of a portion of the electronic paper display;

based at least in part on receiving the first indication:

identifying at least one of a height, a width, or an area of the portion;

determining the at least one of the height, the width, or the area of the portion satisfies one or more criteria;

based at least in part on determining that the at least one of the height, the width, or the area satisfies the one or more criteria:

instructing the display controller to perform the first update of the portion using black and white pixels;

determining a second indication corresponding to a second update of the portion is not received within a set period of time; and instructing the display controller to perform a third update of the portion in grayscale based at least in part on determining the second indication was not received.

2. The one or more non-transitory computer-readable media as recited in claim 1, wherein the instructing the display controller to perform the first update comprises instructing the display controller to perform the first update using only black and white pixels.

3. The one or more non-transitory computer-readable media as recited in claim 1, wherein the portion comprises a rectangular portion of the electronic paper display that includes each pixel of the electronic paper display that is to be updated.

4. The one or more non-transitory computer-readable media as recited in claim 1, wherein the determining the at least one of the height, the width, or the area of the portion satisfies the one or more criteria comprises at least one of:

determining the height of the portion is greater or lesser than a threshold height;

determining the width of the portion is greater or lesser than a threshold width; or determining the area of the portion is greater or lesser than a threshold area.

5. The one or more non-transitory computer-readable media as recited in claim 1, wherein the identifying comprises identifying the height, the width, and the area of the portion, and the determining the at least one of the height, the width, or the area of the portion satisfies the one or more criteria comprises:

determining the height of the portion is greater or lesser than a threshold height;

determining the width of the portion is greater or lesser than a threshold width; and determining the area of the portion is greater or lesser than a threshold area.

6. The one or more non-transitory computer-readable media as recited in claim 1, the acts further comprising:

receiving an identifier of an area of the electronic paper display prior to receiving the first indication; and determining the portion is within the identified area;

and wherein the identifying of the at least one of the height, the width, or the area and the determining the at least one of the height, the width, or the area of the portion satisfies the one or more criteria also occur based at least in part on determining that the portion is within the identified area.

7. The one or more non-transitory computer-readable media as recited in claim 6, wherein the determining the portion is within the identified area comprises:

determining the portion is entirely within the identified area; or determining the portion is partially within the identified area.

8. A method comprising:

under control of an electronic device that includes a display and that is configured with executable instructions, receiving a first indication corresponding to a first update that is to occur on a portion of the display;

determining at least one aspect of the update satisfies one or more predefined criteria; and based at least in part on determining that the at least one aspect satisfies the one or more predefined criteria:

instructing a controller of the electronic device to perform the first update in a first mode;

determining a second indication corresponding to a second update that is to occur on the portion of the display is not received within a set period of time; and instructing the controller to perform a third update in a second, different mode based at least in part on determining that the second indication was not received.

9. The method as recited in claim 8, wherein the portion is less than the entire display.

10. The method as recited in claim 8, wherein the at least one aspect comprises at least one of a height of the portion, a width of the portion, or an area of the portion.

11. The method as recited in claim 8, wherein the first mode comprises performing the first update of the portion of the display using only black and white pixel values.

12. The method as recited in claim 8, wherein the second mode comprises performing the third update of the portion of the display using black, white, and gray pixel values.

13. The method as recited in claim 8, wherein the first and second modes cause the controller to use respective waveforms to update the display.

14. The method as recited in claim 8, further comprising:

receiving, prior to receiving the first indication, an identifier of an area of the display; and determining the portion is within identified area;

and wherein the determining the at least one aspect satisfies the one or more criteria also occurs based at least in part on determining that the portion is within the identified area.

15. The method as recited in claim 14, wherein the identified area of the display corresponds to at least part of a virtual keyboard rendered on the display, and the portion comprises a key of the virtual keyboard.

16. The method as recited in claim 8, wherein:

the first indication is received from an application;

the application filled a framebuffer of the electronic device with values of pixels of the portion, the values including respective values corresponding to white, gray, and black; and the instructing the controller to perform the first update comprises instructing the controller to change each of the values corresponding to gray to a value of white or black prior to performing the first update in the first mode.

17. An electronic device comprising:

a display;

a display controller to perform updates on the display;

one or more processors; and memory storing computer-executable instructions that, when executed by the one or more processors, cause the one or more processors to perform acts comprising:

determining a portion of the display to be updated is within a predefined area of the display;

based at least in part on determining that the portion is within the predefined area:

instructing the display controller to perform a first update of the portion using a first mode;

determining a second indication corresponding to a second update of the portion is not received within a set period of time; and instructing the display controller to perform a third update of the portion using a second, different mode based at least in part on determining that the second indication was not received.

18. The electronic device as recited in claim 17, wherein the first update using the first mode comprises performing the first update of the portion using black and white pixels free from gray pixels, and the third update using the second mode comprises performing the third update of the portion using black, white, and gray pixels.

19. The electronic device as recited in claim 17, wherein the display controller performs the first update in the first mode faster than the third update in the second mode.

20. The electronic device as recited in claim 17, the acts further comprising determining at least one aspect of the portion satisfies one or more criteria.

21. The electronic device as recited in claim 17, the acts further comprising:

identifying at least one of a height, a width, or an area of a rectangle encompassing the portion; and determining the at least one of the height, the width, or the area of the rectangle satisfies one or more criteria.

* * * * *